US006935465B2

(12) United States Patent
Friedli

(10) Patent No.: US 6,935,465 B2
(45) Date of Patent: Aug. 30, 2005

(54) METHOD FOR MODERNIZATION OF AN ELEVATOR INSTALLATION

(75) Inventor: Paul Friedli, Remetschwil (CH)

(73) Assignee: Inventio Ag, Hergiswil (CH)

( * ) Notice: Subject to any disclaimer, the term of this patent is extended or adjusted under 35 U.S.C. 154(b) by 148 days.

(21) Appl. No.: 10/316,502

(22) Filed: Dec. 11, 2002

(65) Prior Publication Data

US 2003/0121728 A1 Jul. 3, 2003

(30) Foreign Application Priority Data

Dec. 17, 2001 (EP) ..... 01811233

(51) Int. Cl.[7] ..... B66B 1/28
(52) U.S. Cl. ..... 187/247; 187/380; 187/389
(58) Field of Search ..... 187/247, 380, 187/382, 391, 384, 389, 393

(56) References Cited

U.S. PATENT DOCUMENTS 4,718,520 A 1/1988 Schroder
4,844,204 A 7/1989 Ovaska et al.
5,352,857 A 10/1994 Ovaska
5,357,064 A * 10/1994 Boyce et al. ..... 187/247
5,389,748 A * 2/1995 Burke et al. ..... 187/247
6,011,839 A 1/2000 Friedli et al.
6,129,182 A * 10/2000 Nakamura ..... 187/391
2002/0023804 A1 * 2/2002 Pfeffer ..... 187/384

FOREIGN PATENT DOCUMENTS

EP 0 523 601 1/1993
EP 0 631 965 1/1995

* cited by examiner

*Primary Examiner*—Jonathan Salata
(74) *Attorney, Agent, or Firm*—Butzel Long

(57) ABSTRACT

A method for the modernization of an elevator installation having at least one elevator and at least one elevator control for controlling the elevator by way of at least one call report. The elevator installation is equipped with a destination call control during preparatory operations for modernization which control includes at least one floor terminal for the input of destination call reports or for the recognition of identification codes of uses. The destination call control also includes at least one computing unit for evaluating the destination call reports or for association of destination floors with recognized identifications codes. The computing unit issues at least one destination signal and controls the elevator installation by way of at least one device. The device reads the destination signal, converts it into at least one call report and controls an existing elevator control by the call report.

15 Claims, 3 Drawing Sheets

METHOD FOR MODERNIZATION OF AN ELEVATOR INSTALLATION

BACKGROUND OF THE INVENTION

The present invention relates generally to a method and a computer program product for the modernization of an elevator installation.

Elevator installations for conveying persons and goods are relatively long-term investment products with service lives of 20 years and more. If after such a length of time a general overhaul of the elevator installation is needed, the components of the elevator installation are often old in terms of technology, which obliges a more or less complete exchange of components. Such an exchange of components of an elevator installation is termed a "modernization" in the following. The modernization is often carried out staggered in time, wherein control units and elevator cars are modernized in a first stage, while drives are modernized in the machine room in a further stage, and floor call transmitters are modernized at the individual floors in a final stage.

The U.S. Pat. No. 5,352,857 shows a method for the modernization of an elevator installation. The elevator installation consists of a group of elevators that convey passengers in a building, wherein each elevator is controlled by an elevator control. In order to maintain the transport capacity of the elevator installation during the modernization, the modernization work is undertaken in a modular manner and in time segments. A first method step consists of incorporating a group control and several adapter units. The adapter units are mounted at the elevator controls and act between the individual elevator controls and the new group control. In this manner there is formed a communications network that allows control of the individual elevators by way of the new group control. In further method steps, existing components of the elevator installation are—at freely selectable later moments in time—combined in modules. Existing elevator installation components—such as the drive in the engine room, the floor call transmitters in the floors, etc.—are then selected and removed in the manner of modules and replaced by new, corresponding elevator installation components. When all modules have been replaced, the elevator controls and the adapter units are removed in a further method step and replaced by a safety system interface in order to control the individual elevators from the group control by way of the safety system interface.

Disadvantages of this method of modernization of an elevator installation are that the transport capacity of the elevator installation has to be maintained as best as possible during the modernization, that the modular modernization can be drawn out in time and that the method is material-intensive and thus costly in realization.

In many cases, however, modernization of an elevator installation is carried out in order to produce an increase in the efficiency of the elevator installation or to increase the travel comfort for the users. Thus, passengers want to be transported as quickly and directly as possible, with long waiting times or a re-boarding being perceived as disagreeable. In addition, accelerations and retardations of the elevator cars should be hardly detectable by the users.

SUMMARY OF THE INVENTION

A first object of the present invention is to provide a method and a computer program product in order to increase the efficiency of the elevator installation or enhance the travel comfort for users even during modernization of the elevator installation. A further object of the present invention is to realize this method and this computer program product economically and quickly. Finally, the present invention shall be compatible with proven standards of machine construction and the electronics industry.

According to the present invention, an elevator installation, which is disposed in a building and is to be modernized, is equipped with a destination call control within the framework of preparatory operations for modernization of the elevator installation. The destination call control comprises at least one floor terminal that is mounted at a floor. A passenger inputs a destination call at the floor terminal or an identification code of the passenger is recognized at the floor terminal. The destination call control detects the boarding floor and the destination floor by a single destination call report or automatically associates a destination floor with an identification code recognized at a boarding floor. A destination call report thus comprises data not only with respect to the boarding floor, but also with respect to the destination floor. Traditional call reports containing only one item of information or report only a boarding floor or only a destination floor to the elevator control are superfluous by virtue of the destination call control. In particular, the destination call control avoids the need for a passenger at a boarding floor to input a first call report at a floor call transmitter in order to call a elevator to the boarding floor and then to input a second call report in the elevator car at a car call transmitter in order to indicate a destination floor.

The destination call control comprises at least one computing unit which evaluates the destination call reports or unambiguously identifies passengers on the basis of identification codes and assigns a predetermined destination floor to identified passengers. Further data, such as data about the building or data about the actual passenger arrival, flow into this evaluation of the destination call reports or association of the identification code. According to a conveying result, an elevator is allocated to each passenger and the passenger is thus conveyed in the shortest time or with the greatest travel comfort, for example with low waiting times or if possible without changeovers, to a destination floor.

The destination call control controls an existing elevator control of the elevator installation, which is to be modernized, by way of at least one device. The device has an intermediary function in that it converts the conveying result ascertained by the computing unit into at least one call report to the elevator control. The computing unit communicates at least one destination signal to the device, which destination signal is converted by the device into at least one call report by which the elevator control is controlled. In this manner the elevator installation to be modernized can be equipped with a destination call control and is in that case further operated in accordance with call reports by the existing elevator control.

The device documents the behavior of the elevator control as at least one travel time profile. The elevator control is in that case to be regarded as a kind of 'black box', the behavior of which is predictable in a learning process. For this purpose, at least one signal of the elevator control is monitored and the course thereof over time is documented as a travel time profile. The travel time profile contains data such as the acceleration, speed and retardation of the elevator car as a function of the length of the conveying path, the carriage load, etc. Advantageously, a large number of travel time profiles is documented.

The invention relates to at least one computer program product which analyses the travel time profile and provides data with respect to the elevator installation as at least one advance selector. The advance selector indicates for a travelling elevator car that floor at which the elevator car could still stop. For ascertaining the advance selector, the computer program product compares the course over time of the actual monitored signal with travel time profiles and selects that travel time profile which reproduces with the greatest probability, or substantially reproduces, the time course of the actual monitored signal. Advantageously, an advance selector is actualized for each elevator of the elevator installation at continuous time intervals and communicated to the destination call control. This actualized advance selector flows as further information into the evaluation of the conveying result by the computing unit. The advance selector enables a fast assignment of a passenger to an elevator car and thus reduces waiting times of the passenger. In addition, the advance selector makes it possible for the elevator car to be accelerated or retarded in a hardly detectable manner and thus guarantees a high travel comfort for the passenger. The documentation of a large number of travel time profiles enables an accurate determination of the advance selector and optimizes the efficiency of the elevator installation.

The equipping of the elevator installation with a destination call control can be carried out quickly, for example within a few hours, for example in times of low loading of the elevator installation. For that purpose the elevator control is connected by way of at least one electrical line with the device. The floor terminal is mounted and the computing unit is installed. The system consists of the floor terminal, the computing unit and the device, which are connected together by way of at least one data bus. The individual components of the system are standardized and can be produced economically.

The elevator installation prepared in that manner for modernization is simple and uncomplicated to modernize. Due to the fact that traditional call reports have become superfluous by virtue of the preparatory operations and that the efficiency of the elevator installation has been increased, an elevator installation can be modernized without disadvantages for the passengers. Advantageously, an elevator installation with several elevators is modernized in a modular manner in at least one method step. By contrast to the state of the art according to the U.S. Pat. No. 5,352,857, elevator installation components are not, however, combined into modules and such a module modernizes the elevator installation in each method step, but at least one elevator is substantially completely modernized in each method step. With advantage, an elevator car of an elevator installation is modernized in one method step, the drive of this elevator is modernized, the conveying cable of this elevator is modernized, the elevator control of this elevator is modernized and the device is removed from this elevator.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
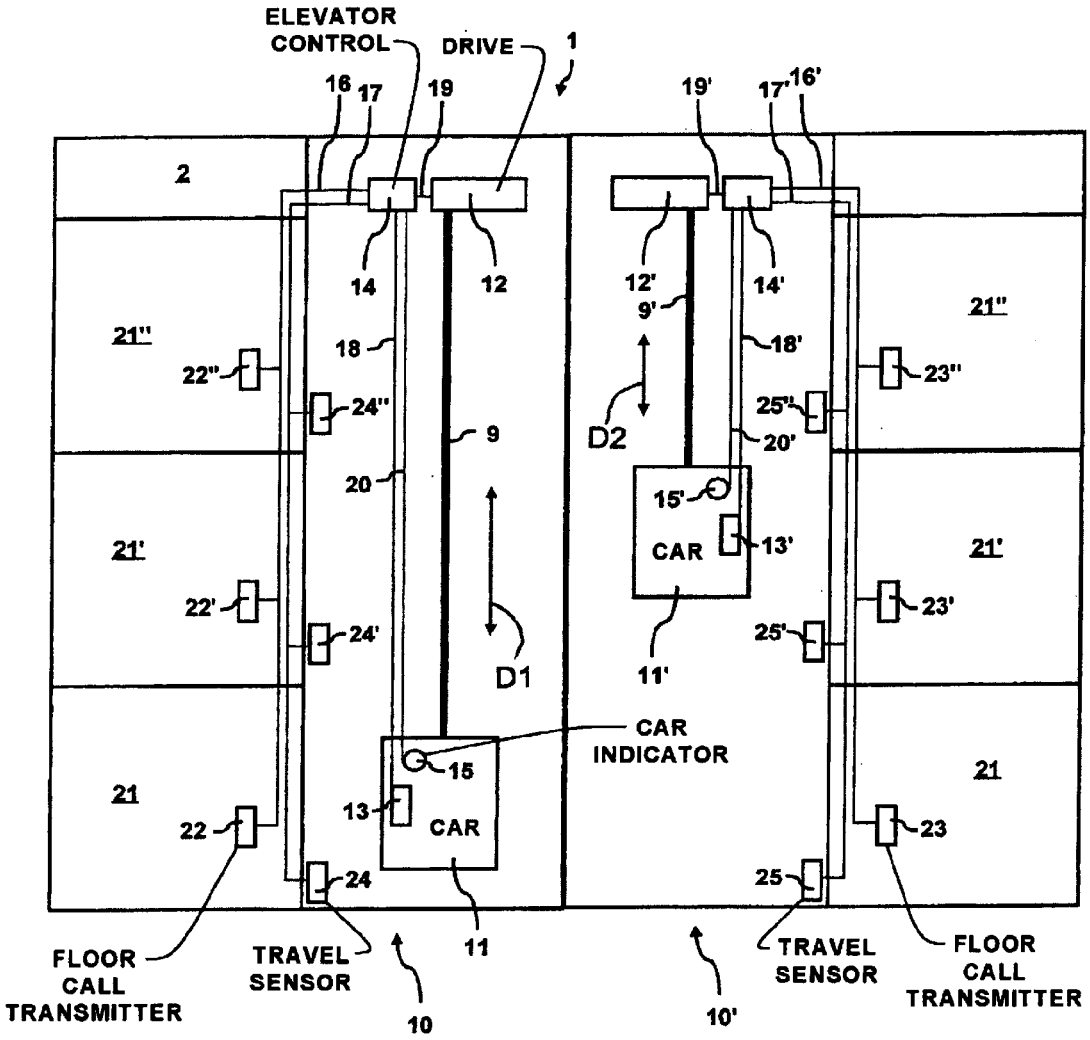
Fig. 1 (PRIOR ART)
FIG. 1 is a schematic diagram of a portion of a prior art elevator installation to be modernized in accordance with the present invention.

FIG. 1 shows a portion of an exemplary embodiment of a prior art elevator installation 1 to be modernized, with at least one elevator 10 that is controlled by at least one elevator control 14. The elevator installation 1 is located in, for example, a building 2 with a plurality of floors 21, 21', 21" and serves for conveying users such as persons or goods from one of the floors to another one of the floors. Although the building 2 is shown as having the three floors 21, 21', 21", which are accessible by way of the elevator installation 1, the building can have more or less floors provided with the elevator service.

In the illustrated example, the elevator installation 1 has two elevators 10, 10' that are arranged, for example, parallel and adjacent to one another. Each of the elevators 10, 10' includes an associated elevator car 11, 11' which is moved, for example suspended at a respective conveying cable 9, 9', by way of a respective drive 12, 12' from one of the floors 21, 21', 21" to another. The vertical conveying direction of the elevators 10, 10' is indicated according to FIGS. 1 and 2 by a double-headed arrow D1, D2 respectively.

The drives 12, 12' are controlled by a respective elevator control 14, 14', wherein in known manner at least one target value is produced, at least one regulating function is present and at least one start or at least one stop is realized. The actual position of the elevator car 11, 11' is detected, for example, by way of at least one travel sensor 24, 24', 24", 25, 25', 25" at the floors and communicated as at least one travel signal to the elevator control 14, 14'. For example, the first travel sensors 24, 24', 24" for the first elevator 10 are mounted at the floors 21, 21', 21" respectively and the second travel sensors 25, 25', 25" for the second elevator 10' are mounted in a similar manner.

The users pass by way of access means into or out of the elevator cars 11, 11'. For example, the users at each of the floors 21, 21', 21" pass by way of an access means in the form of a floor door (not shown) into or out of the elevator cars 11, 11'. Each of the elevator cars 11, 11' has, for example, an access means in the form of a elevator car door (not shown) through which the users pass into or out of the elevator car. In the elevator cars 11, 11' the actual position of the elevator car is indicated to the user by way of at least one car indicator 15, 15' respectively.

The elevator installation 1 is operated by users outside the elevator cars 11, 11' by way of at least one floor call transmitter 22, 22', 22", 23, 23', 23" which is arranged, for example, at an associated one of the floors 21, 21', 21" near the elevator installation 1 and which has at least one input means for the input of a first call report. For example, at each of the floors 21, 21', 21" a respective one of first floor call transmitters 22, 22', 22" is arranged near the floor door of the first elevator 10 and at each of the floors a respective one of second floor call transmitters 23, 23', 23" is arranged near the floor door of the second elevator 10'.

The elevator installation 1 is operated by users in the interior of the elevator cars 11, 11' by way of at least one car call transmitter 13, 13' respectively, which has at least one input means for the input of a second call report. These traditional call reports contain a single item of information. For example, the first call report indicates a conveying destination direction (upwards or downwards) or a boarding floor. The second call report indicates, for example, a destination floor.

The different components of the elevator installation 1, such as the floor call transmitters 22, 22', 22", 23, 23', 23", the car call transmitters 13, 13', the travel sensors 24, 24', 24", 25, 25', 25", the elevator controls 14, 14', the drives 12, 12' and the car indicators 15, 15' are connected together by way of at least one electrical line:

For example, the floor call transmitters 22, 22', 22", 23, 23', 23" are each connected by way of at least one electrical floor call transmitter line 16, 16' with at least one input of the respective elevator control 14, 14' and thus this connection enables communication of the first call report to the associated one of the elevator controls.

For example, the car call transmitters 13, 13' are each connected by way of at least one electrical car call transmitter line 18, 18' with at least one input of the respective elevator control 14, 14' and thus this connection enables communication of the second call report to the associated one of the elevator controls.

For example, the travel sensors 24, 24', 24", 25, 25', 25" are each connected by way of at least one electrical travel sensor line 17, 17' with at least one input of the respective elevator control 14, 14' and thus this connection enables communication of a travel signal to the associated one of the elevator controls.

For example, the drives 12, 12' are each connected by way of at least one electrical drive line 19, 19' with at least one output of the respective elevator control 14, 14' and thus this connection enables communication of a target value to the associated one of the drives.

For example, the car indicators 15, 15' are each connected by way of at least one electrical car indicator line 20, 20' with at least one output of the respective elevator control 14, 14' and thus this connection enables communication of at least one indicating signal to the associated one of the car indicators.

These call reports, the travel signal, the target value and this indicating signal are, for example, analog electrical signals of defined current strength, voltage, frequency, period, etc.

The operation of the elevator installation 1 shown in FIG. 1 functions, for example, as follows:

A user actuates one of the floor call transmitters 22, 22', 22", 23, 23', 23" at a boarding floor.

According to a first call report, which is communicated by way of the electrical floor call transmitter line 16, 16' to the elevator control 14, 14', the elevator control controls a drive 12, 12' and moves the elevator car 11, 11' to the boarding floor.

After the elevator car 11, 11' has reached the boarding floor, the user boards the elevator car and actuates the car call transmitter 13, 13'.

According to a second call report, which is communicated by way of the electrical car call transmitter line 18, 18' to the elevator control 14, 14', the elevator control controls the drive 12, 12' and moves the elevator car 11, 11' from the boarding floor to the destination floor.

After reaching the destination floor, the user disembarks from the elevator car 11, 11'.

When the elevator installation 1 shown in FIG. 1 is to be modernized, the method and apparatus according to the present invention are used for this purpose.

Figure 2:
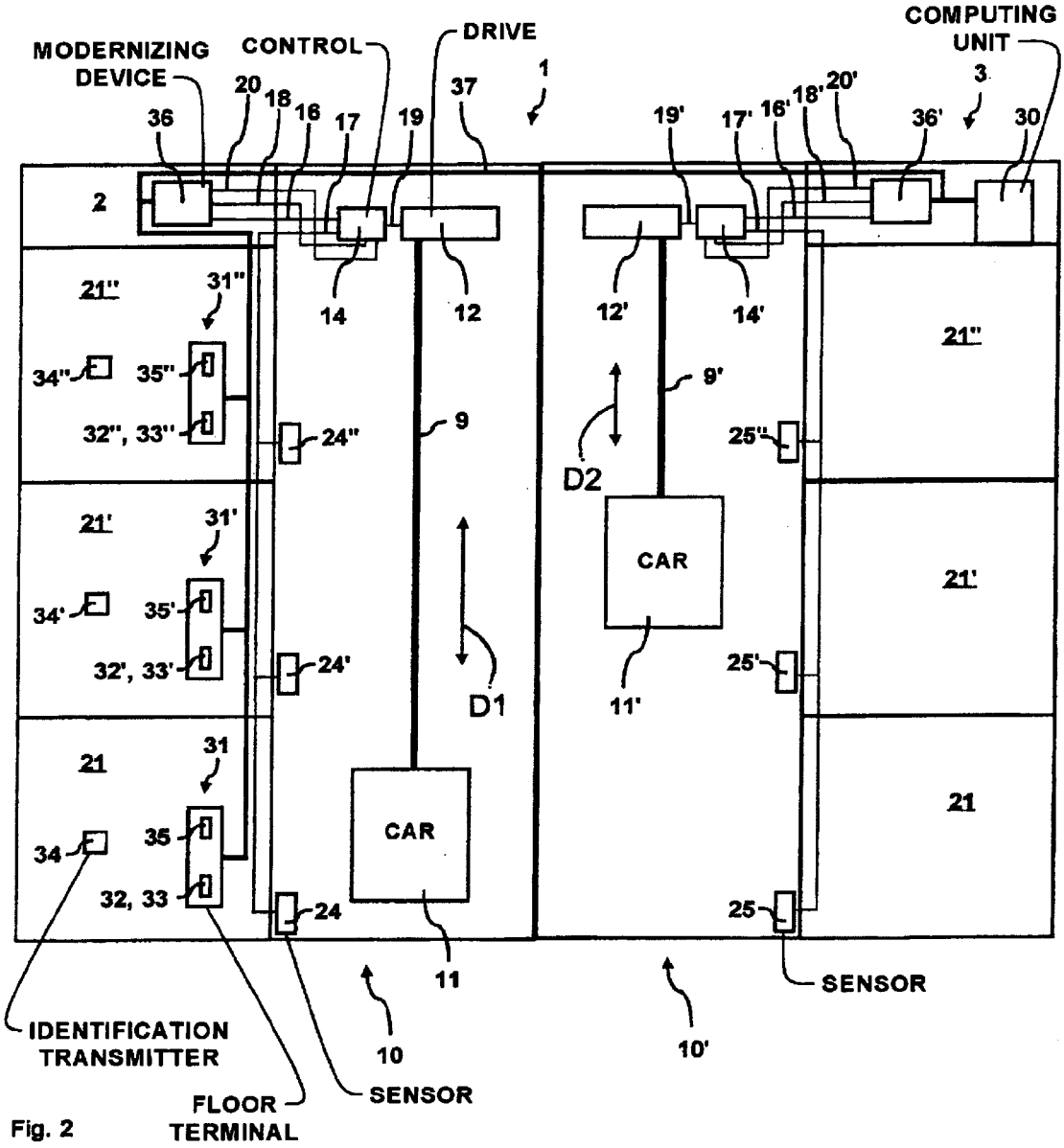
FIG. 2 shows the portion of the elevator installation according to FIG. 1 at the conclusion of preparatory operations for modernization including installing the device according to the present invention.

FIG. 2 shows the elevator installation 1 after the conclusion of preparatory operations in accordance with the present invention for the modernization of the elevator installation. According to the method of the preparatory operations, the elevator installation 1 is equipped with a destination call control 3.

The principle of operation of the destination call control 3 is shown in the European patent document EP 0 246 395. The destination call control 3 comprises at least one floor terminal 31, 31', 31" which is arranged, for example, at each of the floors 21, 21', 21" respectively near the elevator installation 1. The floor terminals 31, 31', 31" each comprise at least one manual input means 32, 32', 32" for input of a destination call report or at least one recognition device 33, 33', 33" for the recognition of at least one identification code. The recognition of an identification code communicated by at least one identification transmitter 34, 34', 34" to the recognition device 33, 33', 33" is known from the document EP 0 699 617. The destination call control 3 detects, by a single destination call report, the boarding floor and the destination floor or automatically assigns a destination floor to an identification code recognized at a boarding floor. A destination call report comprises data regarding not only the boarding floor, but also the destination floor.

The destination call control 3 comprises at least one computing unit 30. The computing unit 30 is, for example, a commercially available personal computer or a workstation. The computing unit 30 includes at least one processor and at least one data memory. The computing unit 30 is arranged at any suitable location, for example in a vestibule of the building 2 or in a computer room of the building, etc. The computing unit 30 executes at least one computer program product for the evaluation of destination call reports or for the association of recognized identification codes with destination floors. This computer program product is, for example, stored in the data memory and is loaded into the processor for execution thereof.

For example, an evaluation of the destination call reports runs as follows:

The computer program product for evaluation of destination call reports records an input time of each destination call report with a statement of the boarding floor as well as of the desired destination floor in at least one request table.

This computer program product compares the distance between the boarding floor and the actual position of the at least one elevator car 11, 11'. This computer program product also computes the distance between the boarding floor and the destination floor. In addition, this computer program product takes into consideration the actual user presence and computes possible intermediate stops along the conveying path.

On the basis of these data, this computer program product performs an optimization and ascertains for each destination call report at least one conveying result. The conveying result denotes the most favorable elevator 10, 10' for conveying the user, i.e. the elevator which conveys the user most quickly or with the highest degree of travel comfort to the destination floor.

An assignment of recognized identification codes with destination floors runs, for example, as follows:

The computer program product for association of recognized identification codes with destination floors records a recognition time of a recognized identification code under a statement of the boarding floor in a requests table.

In the data memory a user profile with at least one user-specific statement is led to a destination floor. This user profile is unambiguously identifiable by way of an identification address. Exactly one identification code exists for each identification address. For example, an identification address is able to be exactly associated with an identification code when the identification address and identification code are identical.

This computer program product compares the recognized identification code with the identification addresses of stored user profiles. This computer program product then precisely delivers a positive association result when one of the stored identification addresses is identical with the recognized identification code, but otherwise this computer program product delivers a negative association result.

This computer program product records the destination floor in the requests table.

This computer program product compares the distance between the boarding floor and the actual position of the at least one elevator car 11, 11'. In addition, this computer program product computes the distance between the boarding floor and destination floor. This computer program product also takes into consideration the actual user presence and computes possible intermediate stops along the conveying path.

On the basis of this data, this computer program product performs an optimization and ascertains at least one conveying result for each recognized identification code. The conveying result denotes the most favorable elevator 10, 10' for conveying the user, i.e. the elevator which conveys the user the most quickly or with the highest degree of travel comfort to the destination floor.

The conveying result is converted. Advantageously, the elevator 10, 10' allocated to the destination floor of the user is indicated to the user. For this purpose, the floor terminal 31, 31', 31" has at least one elevator indicator 35, 35', 35". The computing unit 30 executes at least one computer program product for the control of the elevator installation 1. The computing unit 30 controls the elevator installation 1, which is to be modernized, by way of at least one modernizing device 36, 36'. By the term "control" there is to be understood an indirect control. In the present case, the existing elevator control 14, 14' is controlled by the computing unit 30 indirectly by way of the modernizing device 36, 36'. The floor terminals 31, 31', 31", the computing unit 30 and the devices 36, 36' communicate with one another by way of at least one data bus 37. The data bus 37 can be any modern standard bus. Such data buses are known to the expert. The data bus can be based on electrical or optical signal transmission, such as an Ethernet network, a Tokenring network, etc. It can also be a radio network, an infrared network, a radar network, a radio beam network, etc. With knowledge of the present invention, numerous possibilities of realization with respect thereto are open to the expert.

Figure 3:
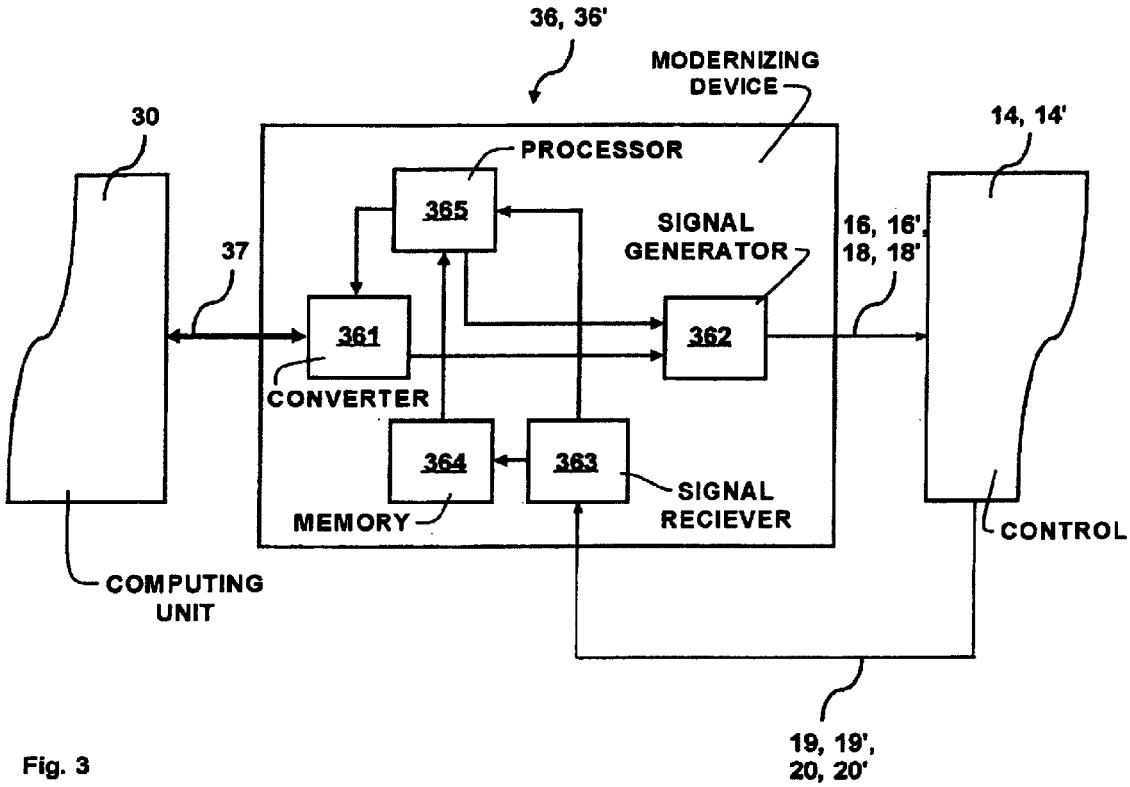
FIG. 3 is a schematic block diagram of a portion of the device shown in FIG. 2.

FIG. 3 shows the devices 36, 36' in more detail. The computing unit 30 issues by way of the data bus 37 at least one destination signal to the device 36, 36'. The device 36, 36' comprises, for example, at least one input for the data bus 37 for the reception of the destination signal. For example, the destination signal is transmitted to the device 36, 36' in accordance with at least one communication protocol of the data bus 37 and is read by the device 36, 36'. The device 36, 36' comprises, for example, at least one converter 361 which accepts the destination signal and converts it into a call report. The converter 361 is a commercially available and proven converter of the electronics industry.

The device 36, 36' and the elevator control 14, 14' are connected together by way of at least one electrical line. The device 36, 36' further comprises, for example, at least one output for the issue of call reports. This output is connected with the elevator control 14, 14' by way of the floor call transmitter line 16, 16' as well as the car call transmitter line 18, 18'. The call reports are issued to the elevator control 14, 14' from at least one signal generator 362 of the device 36, 36'. It is advantageous, but not obligatory, to arrange the device 36, 36' near the elevator control 14, 14'. The signal generator 362 is a commercially available and proven signal generator of the electronics industry.

The operation of the modernized elevator installation 1 functions, for example, as follows:

A user inputs, at a boarding floor, a destination call report by way of the manual input means 32, 32', 32" of the floor terminal 31, 31', 31" or the user carries the identification transmitter 34, 34', 34" and communicates an identification code to the recognition device 33, 33', 33" of the floor terminal 31, 31', 31", which identification code is recognized by the recognition device.

The floor terminal 31, 31', 31" communicates to the computing unit 30 by way of the data bus 37 a conveying signal corresponding with the destination call report or an identification signal corresponding with a recognized identification code.

The computing unit 30 executes the computer program product and ascertains at least one conveying result for the conveying signal or for the identification signal.

At least one control signal for controlling the elevator installation 1 is issued as conveying result.

The control signal comprises a user information signal which is communicated by way of the data bus 37 to the floor terminal 31, 31', 31" at the boarding floor where the user has made the destination call report. According to the user information signal, the elevator 10, 10' allocated to the destination floor of the user is indicated to the user on the elevator indicator 35, 35', 35".

The control signal comprises at least one first destination signal which is communicated by way of the data bus 37 to the device 36, 36'. According to this first destination signal the device 36, 36' issues by way of an electrical line a first call report to the elevator control 14, 14'. According to this first call report the elevator control 14, 14' controls the drive 12, 12' and moves the elevator car 11, 11' to the boarding floor.

After the elevator car 11, 11' has reached the boarding floor, the user boards the elevator car.

The control signal comprises at least one second signal which is communicated by way of the data bus 37 to the device 36, 36'. According to this second destination signal the device 36, 36' issues a second call report to the elevator control 14, 14' by way of an electrical line. According to this second call report the elevator control 14, 14' controls the drive 12, 12' and moves the elevator car 11, 11' from the boarding floor to the destination floor. The user is conveyed without further action to the destination floor.

After reaching the destination floor the user disembarks from the elevator car 11, 11'.

The device 36, 36' has, at least one input, at least one signal receiver 363 for detection of at least one signal of the elevator control 14, 14'. The signal is monitored at at least one input or at at least one output of the elevator control 14, 14'. Advantageously, this input of the device 36, 36' is connected by way of the drive line 19, 19' and/or the car indicator line 20, 20' with the elevator control 14, 14'. The signal receiver 363 detects, for example, at least one target value of the drive line 19, 19' and/or at least one indication signal of the car indicator line 20, 20'. The signal receiver 363 is a commercially available and proven signal receiver of the electronics industry.

The behavior of this target value and/or of this indication signal over time is documented as at least one travel time profile. The travel time profile is a protocol with regard to the mode of function of the elevator control 14, 14'. It documents numerous data about the elevator installation 1, such as the acceleration, speed and retardation of the elevator car 11, 11' as a function of the length of the conveying path, the car load, etc. The travel time profile can be documented in any data format. For example, the device 36, 36' includes at least one data memory 364 for storage of the travel time profile.

Two examples of signals monitored at the elevator control 14, 14' serve for illustration:

The elevator control 14, 14' communicates, for example, an indication signal on the car indicator line 20, 20' as a form of acknowledgement for an input call report. This acknowledgement is communicated to the car indicator 15, 15' of the elevator car 11, 11' and is indicated there as the actual position of the elevator car. The indication signal on the car indicator line 20, 20' is, for example, an electrical voltage of five volts direct current and is of different length in time according to the respective floor to be indicated. Thus, the indication signal can, for indication of the first floor, be one second long, whilst that for indication of the second floor is two seconds long. The actual position of the elevator car 11, 11' can thus be determined from this acknowledgement to the car indicator 15, 15'.

For example, the elevator control 14, 14' communicates a target value on the drive line 19, 19' for acceleration or retardation of the elevator car 11, 11'. The target value for acceleration of the elevator car 11, 11' is, for example, an electrical direct current of five volts. The target value for retardation of the elevator car 11, 11' is, for example, an electrical direct current of zero volts. The acceleration or retardation of the elevator car 11, 11' can thus be determined from these target values.

Advantageously, the device 36, 36' executes at least one computer program product which analyses the travel time profile and determines or provides at least one advance selector. An advance selector indicates for the moving elevator car 11, 11' that floor at which the elevator car could still stop. For example, the device 36, 36' includes a data memory 364 for storage of the computer program product and at least one processor 365 for carrying out the computer program product. The computer program product compares, for example, the actually detected indication signal or the actually detected target value with stored travel time profiles. The computer program product selects that travel time profile which substantially corresponds with the course over time of the actually detected indication signal or the actually detected target value and provides this selected travel time profile as an advance selector. By actually detected signal there is understood a signal obtained in real time or in quasi real time. For example, a signal is sampled or monitored every ¼ of a second, preferably every 1/20 of a second, preferably every 1/1000 of a second. Advantageously, an advance selector is actualized at continuous time intervals for each of the elevators 10, 10' of the elevator installation 1 and communicated to the computing unit 30. For example, an advance selector is communicated every ¼ of a second, preferably every 1/20 of a second, preferably every 1/1000 of a second, to the computing unit 30. With knowledge of the present invention, numerous possibilities of realization of variants are open to the expert. Thus, it is entirely possible to perform the computer program product on any computer, for example on the computing unit 30 of the system or on a remote server. In this case the actually detected signal is communicated to the computing unit or to the remote server. Such a communication takes place, for example, over the Internet.

An actualized advance selector flows as further information into the conveying result. The advance selector enables a rapid assignment of a user to an elevator car 11, 11' and thus reduces the waiting times of the user. In addition, the advance selector makes it possible that the elevator car 11, 11' is accelerated or retarded in hardly noticeable manner and thus guarantees a high travel comfort for the user. Through documentation of a large, substantially complete number of travel time profiles, the advance sector can be ascertained with a high degree of accuracy and the efficiency of the elevator installation 1 can be optimized.

The preparatory operations for modernization of the elevator installation 1 consist in mounting at least one floor terminal 31, 31', 31" and installing at least one computing unit 30 as well as at least one device 36, 36'. The system consisting of the floor terminal 31, 31', 31", the computing unit 30 and the device 36, 36' is advantageously composed of prefabricated and, for example, pre-configured units which are simple and quick to mount or to install.

The floor terminals 31, 31', 31" are mounted at each of the floors 21, 21', 21" near the elevator installation 1 with, for example, one floor terminal mounted at each floor as a stand-alone apparatus near the two elevators 10, 10'. This stand-alone apparatus is, for example, fixed in the floor or to a wall of the floor by screws. These floor terminals 31, 31', 31" replace the floor call transmitters 22, 22', 22", 23, 23', 23" or the car call transmitters 13, 13'.

The devices 36, 36' are installed at, for example, each of the elevator controls 14, 14'. For this purpose, the existing electrical floor call transmitter line 16, 16' to the floor call transmitter 22, 22', 22", 23, 23', 23" or the existing electrical car call transmitter line 18, 18' to the car call transmitter 13, 13' is interrupted at the input of the elevator control 14, 14' and this input of the elevator control is, instead, connected by way of an electrical line with an output of the device 36, 36'. Advantageously, the existing electrical drive line 19, 19' at the output of the elevator control 14, 14' is branched off and this output of the elevator control is connected by way of an electrical line with an input of the device 36, 36'. The existing electrical car indicator line 20, 20' to the car indicator 15, 15' is advantageously interrupted at the output of the elevator control 14, 14' and this output of the elevator control is, instead, connected by way of an electrical line with an input of the device 36, 36'. By virtue of the usually small number of inputs and outputs of the elevator control 14, 14', this installation of the device 36, 36' is simple and quick to manage. The device 36, 36' is, for example, fixed near the elevator control 14, 14' by screws.

The floor terminal 31, 31', 31", the computing unit 30 and the device 36, 36' are, for example, connected together by way of the at least one data bus 37. The cable of the data bus 37 is, for example, laid in at least one existing cable shaft of the building 2.

This elevator installation 1 prepared in that manner for modernization is simple and uncomplicated to modernize. Advantageously, the elevator installation 1 with several elevators 10, 10' is modernized in modular manner in at least one method step, wherein at least one elevator 10, 10' is substantially completely modernized in each method step. With advantage, the elevator car 11, 11' of the elevator 10, 10' is modernized in one method step, the drive 12, 12' of this elevator is modernized, the cable 9, 9' of this elevator is modernized, the elevator control 14, 14' of this elevator is modernized and the device 36, 36' of this elevator is removed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of modernizing an elevator installation having at least one elevator controlled by at least one elevator control by way of at least one call report, comprising:

a. installing at least one floor terminal at each floor served by an elevator controlled by an elevator control for at least one of the input of destination call reports and for recognition of identification codes of users;

b. installing at least one computing unit and connecting the at least one computing unit to said floor terminals for at least one of evaluating the destination call reports and association of destination floors with recognized once of the identification codes and for the output of at least one destination signal; and c. installing at least one modernizing device and connecting the at least one modernizing device to said floor terminals and said at least one computing unit for reading the destination signal, for converting the destination signal into at least one call report and for controlling the elevator control by way of the call report.

2. The method according to claim 1 wherein said step c. is performed by interrupting at least one existing electrical floor call transmitter line between at least one floor call transmitter and the elevator control and connecting the elevator control by an electrical line with said modernizing device.

3. The method according to claim 1 wherein said step c. is performed by interrupting at least one existing car call transmitter line between at least one car call transmitter and the elevator control and connecting the elevator control by an electrical line with said modernizing device.

4. The method according to claim 1 including connecting with said modernizing device at least one existing electrical drive line between at least one drive and the elevator control.

5. The method according to claim 4 including detecting at least one target value of the drive line by said modernizing device and documenting the behavior of the target value over time as at least one travel time profile.

6. The method according to claim 5 including comparing at least one actually detected target value with target time profiles, selecting that travel time profile which substantially corresponds with the course over time of the actually detected target value and providing this selected travel time profile as at least one advance selector.

7. The method according to claim 1 including connecting with said modernizing device at least one output for at least one electrical car indicator line of the elevator control.

8. The method according to claim 7 including detecting at least one indicator signal of the car indicator line by said modernizing device and documenting the behavior of the indication signal over time as at least one travel time profile.

9. The method according to claim 8 including comparing at least one actually detected indication signal with target time profiles, selecting that travel time profile which substantially corresponds with the course over time of the actually detected indication signal and providing this selected travel time profile as at least one advance selector.

10. The method according to claim 1 including performing said steps a. through c. for each elevator car and associated elevator control of an elevator installation in succession whereby the elevator installation is modernized in a modular manner.

11. The method according to claim 1 including modernizing the elevator car modernizing a drive associated with the elevator car, modernizing a. conveying cable associated with the elevator car, modernizing the elevator control, and removing said at least one modernizing device from the elevator installation.

12. A method of modernizing an elevator installation having at least one elevator controlled by at least one elevator control by way of at least one call report, comprising:

a. installing at least one floor terminal at each floor served by an elevator controlled by an elevator control for at least one of the input of destination call reports and for recognition of identification codes of users;

b. installing at least one computing unit and connecting the at least one computing unit to said floor terminals for at least one of evaluating the destination call reports and association of destination floors with recognized noes of the identification codes and for the output of at least one destination signal;

c. installing at least one modernizing device and connecting the at least one modernizing device to said floor terminals and said at least one computing unit for reading the destination signal, for converting the destination signal into at least one call report and for controlling the elevator control by way of the call report;

d. connecting with the at least one modernizing device at least one existing electrical drive line between at least one drive and the elevator control; and e. detecting at least one target value of the drive line by the at least one modernizing device and documenting the behavior of the target value over time as at least one travel time profile.

13. The method according to claim 12 including comparing at least one actually detected target value with target time profiles, selecting that travel time profile which substantially corresponds with the course over time of the actually detected target value and providing this selected travel time profile as at least one advance selector.

14. A method of modernizing an elevator installation having at least one elevator controlled by at least one elevator control by way of at least one call report, comprising:

a. installing at least one floor terminal at each floor served by an elevator controlled by an elevator control for at least one of the input of destination call reports and for recognition of identification codes of users;

b. installing at least one computing unit and connecting the at least one computing unit to said floor terminals for at least one of evaluating the destination call reports and association of destination floors with recognized ones of the identification codes and for the output of at least one destination signal; and c. installing at least one modernizing device and connecting the at least one modernizing device to said floor terminals and said at least one computing unit for reading the destination signal, for converting the destination signal into at least one call report and for controlling the elevator control by way of the call report.

15. The method according to claim 14 including comparing at least on actually detected indication signal with target time profiles, selecting that travel time profile which substantially corresponds with the course over time of the actually detected indication signal and providing this selected travel time profile as at least one advance selector.

* * * * *

UNITED STATES PATENT AND TRADEMARK OFFICE

CERTIFICATE OF CORRECTION

PATENT NO. : 6,935,465 B2
APPLICATION NO. : 10/316502
DATED : August 30, 2005
INVENTOR(S) : Paul Friedli It is certified that error appears in the above-identified patent and that said Letters Patent is hereby corrected as shown below:

In the claims: Column 11, Claim 1, line 18, delete "once" and insert --ones--;
after "codes" insert --,--.
Column 12, Claim 11, line 2, after "car" insert --,--;
line 3, delete "a." and insert --a--;
Claim 12, line 19, delete "noes" and insert --ones--.

Cancel claims 14 and 15 in their entirety.

Signed and Sealed this

Eighteenth Day of November, 2008

JON W. DUDAS
*Director of the United States Patent and Trademark Office*